United States Patent [19]

Cox et al.

[11] 4,138,174

[45] Feb. 6, 1979

[54] VENDOR HAVING SLIDING TRAYS AND LATCHES THEREFOR

[75] Inventors: Robert N. Cox, St. Louis County; Albinus G. Bodoh, Blackjack, both of Mo.

[73] Assignee: UMC Industries, Inc., Stamford, Conn.

[21] Appl. No.: 905,375

[22] Filed: May 12, 1978

[51] Int. Cl.[2] ..... A47B 88/16

[52] U.S. Cl. ..... 312/333; 312/348; 221/281

[58] Field of Search ..... 312/333, 341 R, 330, 312/348, 222, 349, 350; 308/3.6, 3.8; 221/75, 281

[56] References Cited

U.S. PATENT DOCUMENTS

| | | | |
|---|---|---|---|
| 2,599,865 | 6/1952 | Rudman | 312/333 |
| 3,123,419 | 3/1964 | Maxwell | 312/333 |
| 3,269,595 | 8/1966 | Krakauer et al. | 221/75 |

*Primary Examiner*—Mervin Stein
*Assistant Examiner*—A. Grosz
*Attorney, Agent, or Firm*—Koenig, Senniger, Powers and Leavitt

[57] ABSTRACT

A vendor having sliding trays or carriers in a cabinet, a latch being pivotably mounted on one side of the cabinet adjacent the front end of one of a pair of channels in which channels the carrier is slidably mounted by means of two series of rollers, the series being on opposite sides of the carrier. Each channel has upper and lower flanges which extend from its respective side toward the opposite side of the cabinet. A pair of rail members are disposed, one on each of the sides of the cabinets, at the forward ends of the channels. Each rail member has a rear upper surface portion generally flush with the lower flange of its channel and a forward upper surface portion which progresses upwardly in forward direction from the rear upper surface portion to a peak. The peaks are spaced from the forward ends of the upper flanges of their respective channels a distance greater than the diameter of the rollers. The latch is mounted above the rail member at that side and is pivotable between a latching position and an unlatching position. In the latching position the latch acts in conjunction with the forward edge of the upper flange at that side to prevent withdrawal of the carrier from the cabinet by confining a roller on the carrier at that side against upward movement away from the rear upper surface portion of the respective rail member. In the unlatching position, the latch permits withdrawal of the carrier by permitting a roller at that side to roll upwardly and forwardly over the peak of its corresponding rail member.

3 Claims, 9 Drawing Figures

VENDOR HAVING SLIDING TRAYS AND LATCHES THEREFOR

BACKGROUND OF THE INVENTION

This invention relates to a cabinet, e.g., a cabinet of a vendor, having sliding trays or carriers therein, and latching means for the carriers.

In machines such as vending machines there are often carriers (e.g., vending trays) that are slidably mounted in the cabinet of the machine. To load these carriers or trays with items to be vended the serviceman slides the trays forwardly out of the cabinet and after the carrier is loaded he slides it back. On occasion it is even necessary to completely remove one or more carriers from the machine cabinet.

It is of course desirable to retain the carrier in its position inside the machine cabinet until the serviceman wishes to slide it forward to fill it. And once the carrier is in its loading position it must be prevented from sliding the rest of the way out of the cabinet.

SUMMARY OF THE INVENTION

Among the objects of this invention may be noted the provision of latching apparatus for a tray of a vendor, which functions, on insertion of the tray in the cabinet, automatically to latch the tray in the cabinet and acts to prevent the tray from being slid out of the cabinet unless it is specifically released by the serviceman, thus reducing the possibility of inadvertent sliding out of the tray; the provision of such latching apparatus which latches the tray, after it has been slid out to a loading position, against removal, unless the latching apparatus is specifically released; the provision of such latching apparatus which requires multiple operation before the tray may slide completely out of the cabinet; and the provision of latching apparatus for the purpose described which is simple in construction and simple to operate yet effective in operation.

Briefly, the apparatus of this invention includes a latch in a cabinet having sides and a front door. On each side is one of a pair of channels for supporting a carrier for sliding movement on opening the cabinet door from an inner position within the cabinet to an outer position extending forward out of the front of the cabinet. Each channel includes an upper flange and a lower flange extending from its respective side toward the other side. On each side of the carrier is a series of rollers, which series of rollers includes a front roller adjacent the front end of the carrier, a rear roller adjacent the rear end of the carrier and an intermediate roller between the forward and the rear roller. On each side at the forward ends of the channels is one of a pair of rail members, each of which has a rear upper surface portion generally flush with the lower flange of its respective channel. Each rail member also includes a forward upper surface portion which progresses upwardly in forward direction from the rear upper surface portion to a peak. Each peak is spaced from the forward end of the upper flange of its respective channel a distance greater than the diameter of the rollers of the carrier. The latch for the carrier is disposed on one of the sides of the cabinet above the rail member at that side. The latch is mounted for pivotal movement between a latching position for preventing withdrawal of the carrier and an unlatching position permitting withdrawal of the carrier. When in the latching position the latch acts in conjunction with the forward edge of the upper flange at that side to confine a roller on the carrier at that side against upward movement away from the rear upper surface portion of the respective rail member. When in the unlatching position the latch permits a roller on the carrier at that side to roll upwardly and forwardly over the peak of its corresponding rail member. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 2:
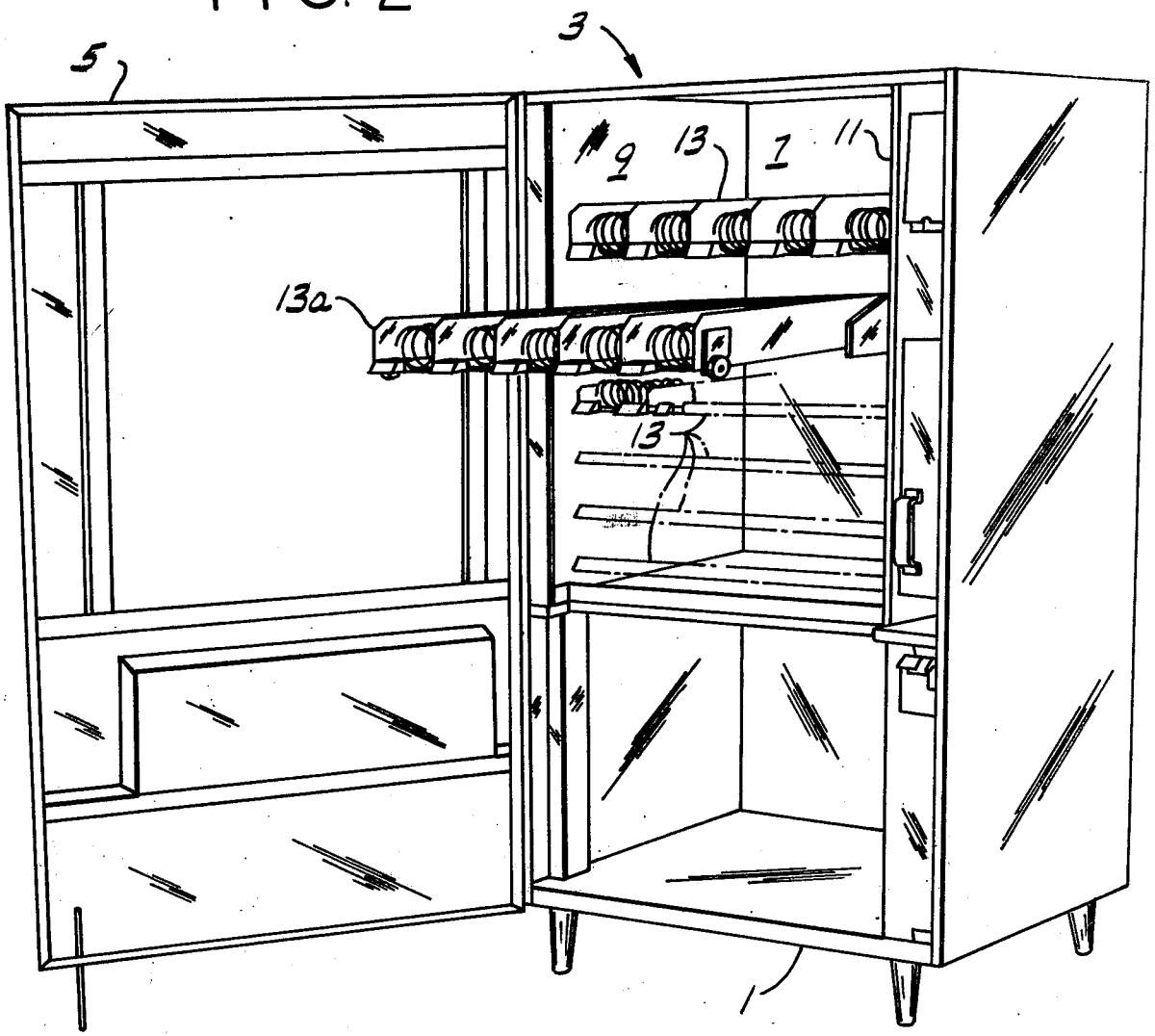
FIG. 2 is a perspective of the vendor of FIG. 1 with a door open and one carrier in a loading position to shown interior detail.
Figure 1:
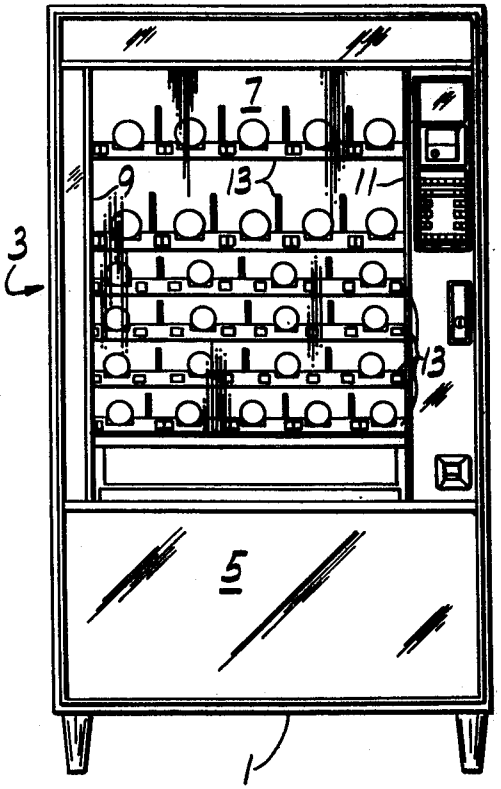
FIG. 1 is a front elevation of a vendor comprising a cabinet incorporating the present invention.

Referring to the drawings, there is shown a vendor 1 comprising a cabinet indicated generally at 3. The cabinet has a door 5, a back 7 and two sides 9 and 11, and a plurality of carriers 13 therein, each of which constitutes a dispensing tray. When the door is opened, each carrier is slidable from an inner position within the cabinet (shown in FIG. 1) to an outer position extending forward out of the front of the cabinet (FIG. 2), as shown for the second carrier from the top, which is specifically designated **13*a***.

Figure 3:
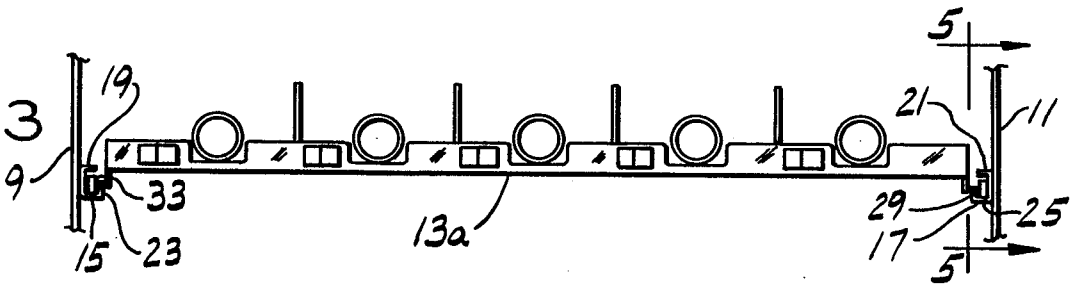
FIG. 3 is an enlarged fragment of FIG. 1 in elevation with the front part of the apparatus of the present invention broken away.

Carrier **13*a* is supported for this sliding movement by a pair of channels designated individually by the reference numerals 15 and 17 (FIG. 3). Each channel includes an upper flange, designated by the reference numerals 19 and 21, and a lower, L-shaped flange, designated by the reference numerals 23 and 25. Flanges 19 and 23 extend from side 9 toward side 11 and at its rightmost extent flange 23 also extends toward flange 19. Likewise flanges 21 and 25 extend from side 11 toward side 9 and at its leftmost extent flange 25 extends upward toward flange 21**.

Figure 4:
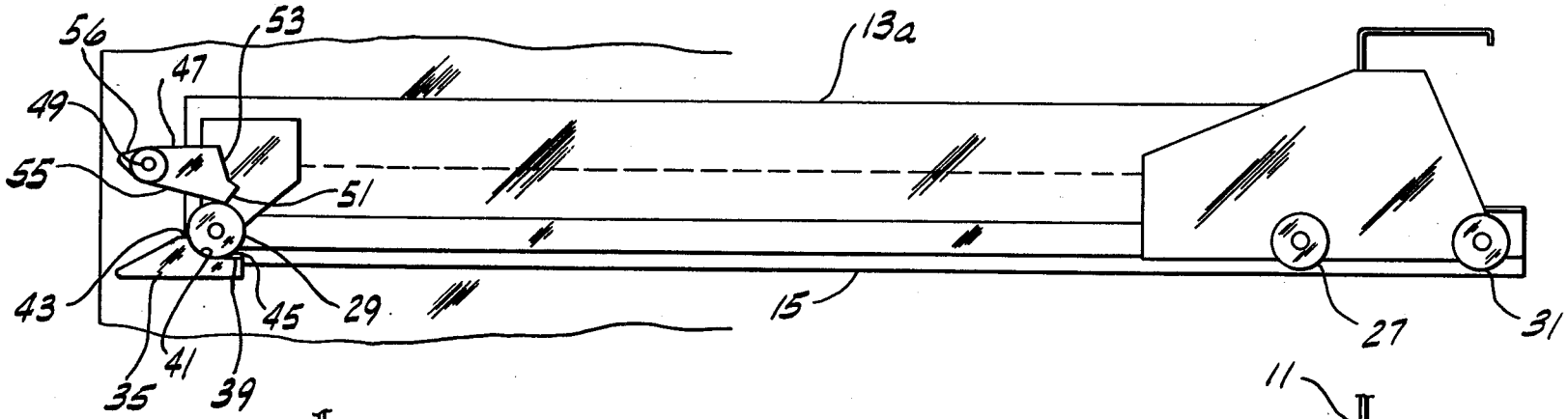
FIG. 4 is an enlarged right-side elevation of a carrier and latch of the present invention showing the carrier in its retracted position in the cabinet and the latch in a raised position bearing on a front roller of the carrier.
Figure 8:
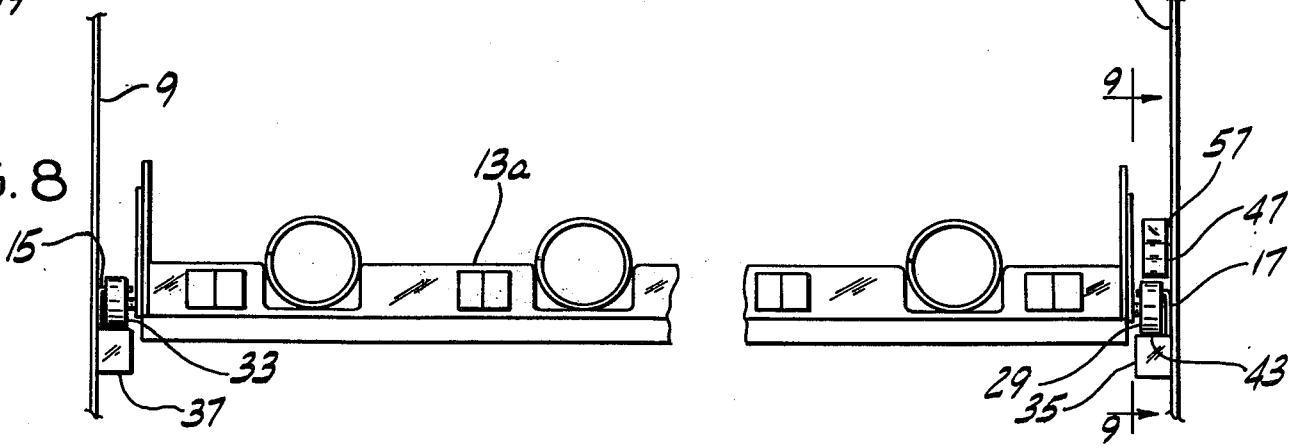
FIG. 8 is a front elevation of the apparatus of the present invention illustrating a latch of the present invention in its unlatching position and a carrier being moved from its innner to its outer position with parts broken away to reduce the length of the view.

Carrier 13*a* has three rollers, designated by the reference numerals 27, 29 and 31, secured to the side of the carrier adjacent channel 17 (FIG. 4) and three additional rollers (only one of which, designated by the reference numeral 33, is shown) secured to the opposite side of carrier 13*a*. Rollers 27, 29 and 31 are of such a diameter D that they roll freely in channel 17 but are larger than a gap S1 (FIG. 5), between flanges 21 and 25. Likewise, the roller 33 and the two rollers not shown are retained in channel 15 by flanges 19 and 23. Roller 27 is intermediate rollers 29 and 31, roller 31 is adjacent the rear end of carrier 13*a* and roller 29 is adjacent the front end of carrier 13*a*. Roller 33 is also adjacent the front end of carrier 13*a* and the two rollers not shown are disposed on their side of carrier 13*a* in positions corresponding to those of rollers 27 and 31.

At the forward ends of channels 15 and 17 are two rail members 35 and 37 (FIGS. 4–9) secured to sides 11 and 9 respectively. Rail member 35 has a rear upper surface portion 39 generally flush with flange 25, i.e., generally flush with that portion of flange 25 on which rollers 27, 29 and 31 roll and on which roller 29 normally rests. Rail member 35 also has a forward upper surface portion 41 which progresses upwardly in forward direction from portion 39 to a peak 43. Rail member 35 is disposed so that the shortest distance between peak 43 and the forward end of flange 21, designated by the reference character S2 is greater than the diameter of rollers 27, 29 and 31. Rail member 35 also includes a rib 45 adjacent surface portions 39 and 41 opposite side 11. Rib 45 is spaced from side 11 a distance sufficient to allow rollers 27, 29 and 31 to pass between it and side 11. Rail member 37 is a mirror image of rail member 35.

Figure 9:
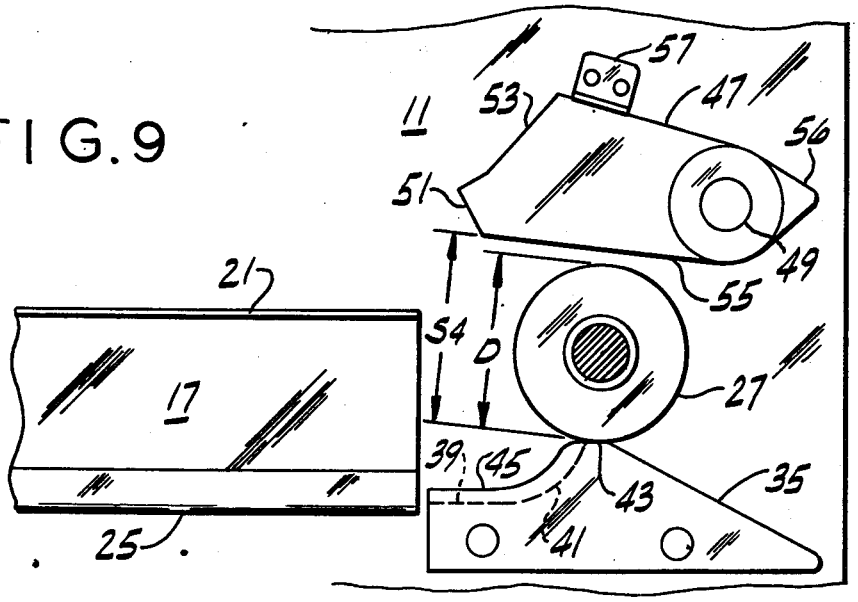
FIG. 9 is a vertical section generally along line 9—9 of FIG. 8 showing an intermediate roller passing under the latch toward the front of the cabinet.

A latch 47 is pivotably mounted on side 11 by a pin 49 which constitutes means mounting latch 47 for pivotal movement between a latching position (FIG. 5) for preventing withdrawal of carrier 13*a* and an unlatching position (FIG. 9) permitting withdrawal of said carrier. Latch 47 includes a base edge portion 51, a rear edge portion 53 extending upwardly from base edge portion 51, a front edge portion 55 inclined up and away from said base edge portion when latch 47 is in its latching position (FIG. 5) and which in the normal position of carrier 13*a* rests atop roller 29, and an upper edge portion 56 on the opposite side of pivot pin 49 from base edge portion 51. The shortest distance, designated by the reference character S3, from rear edge portion 53 to the forward end of upper flange 21 is chosen to be less than the diameter D of roller 27. A stop 57 is also secured to side 11. The position of stop 57 is chosen so that the shortest distance, designated by the reference character S4, between latch 47 and rail member 35 when the latch is engaged by the stop is greater than D, the diameter of the rollers (FIG. 9).

Figure 7:
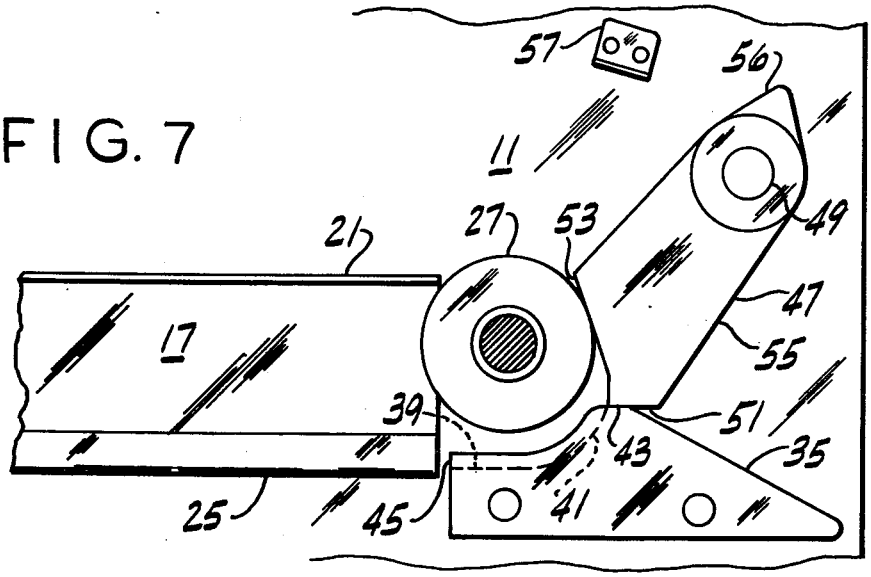
FIG. 7 is an enlarged section similar to FIG. 5 showing the carrier roller engaged by the latch of the present invention.

The operation of the present apparatus is as follows: As the serviceman moves carrier 13*a* forward out of cabinet 3 without manipulating latch 47 (FIG. 8), roller 29 moves freely over peak 43; since portion 55 of latch 47 is resting on top of said roller, latch 47 does not latch roller 29 in place. As he continues moving the carrier forward, roller 27 engages the rear edge portion 53 of latch 47 and further foward movement of carrier 13*a* is prevented. Roller 27 cannot be lifted over latch 47 since diameter D is greater than distance S3 (FIG. 7). That is, rear edge portion 53 of latch 47 acts in conjunction with the forward edge of flange 21 to confine roller 27 against upward movement away from rear upper surface portion 41. Nor can roller 27 be moved sideways around latch 47; the vertical portion of flange 25 and rib 45 of latch 47 prevent such movement. Thus, to move carrier 13*a* to its outer position, e.g., for loading, the serviceman merely moves the carrier forward out of the cabinet until roller 27 engages latch 47.

Figure 5:
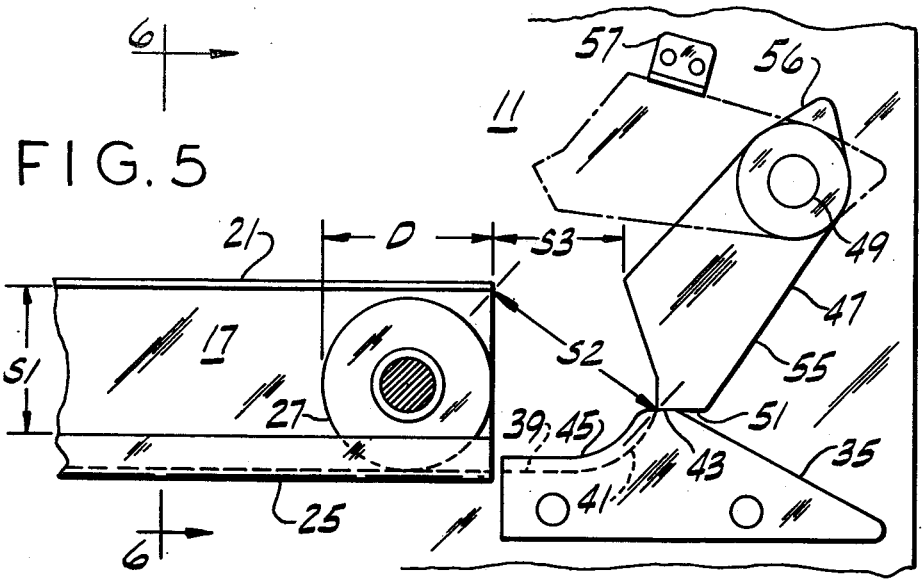
FIG. 5 is an enlarged vertical section generally along line 5—5 of FIG. 3, with parts further broken away, showing an intermediate carrier roller in its position just prior to being engaged by the latch as the carrier is moved forward out of the cabinet.
Figure 6:
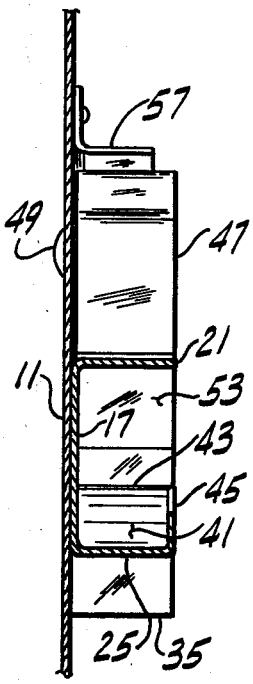
FIG. 6 is a vertical section generally along line 6—6 of FIG. 5 with the carrier roller removed.

To withdraw carrier 13*a* from the cabinet, the serviceman must back the carrier off a sufficient distance, e.g., to the position shown in FIG. 5, to allow free pivoting of latch 47. Then by pressing down on edge portion 56, the serviceman pivots latch 47 clockwise until it is engaged by stop 57 (as shown in phantom in FIG. 5). Roller 27 is now rolled upwardly and forwardly over peak 43 (FIG. 9) by the serviceman to move carrier 13*a* to its outer position. Once roller 27 clears peak 43 the serviceman releases latch 47, which thereupon returns to its latched position. To remove carrier 13*a* entirely from cabinet 3, the serviceman must hold latch 47 against stop 57 while moving rollers 31 over peak 43 also. Reinsertion of carrier 13*a* into cabinet 3 from either its outer position or its completely removed position is easily accomplished. The serviceman simply moves carrier 13*a* toward the rear of cabinet 3 while ensuring that rollers 29, 27 and 31 are in turn engaged by rail member 35. Each roller as it engages latch 47 pushes the latch to its unlatching position and the roller rolls freely over rail member 35 into channel 17.

In view of the above, it will be seen that the several objects of the invention are achieved and other advantageous results attained.

As various changes could be made in the above products without departing from the scope of the invention, it is intended that all matter contained in the above description or shown in the accompanying drawings shall be interpreted as illustrative and not in a limiting sense.

What is claimed is:

1. In a cabinet having sides and a front door, a carrier, a pair of channels, one on each of said sides for supporting the carrier for sliding movement, on opening the door, from an inner position within the cabinet to an outer position extending forward out of the front of the cabinet, each channel comprising an upper flange and a lower flange extending from its respective side toward the other side, a series of rollers on each side of the carrier, each series comprising a front roller adjacent the front end of the carrier, a rear roller adjacent the rear end of the carrier and an intermediate roller between the forward and the rear roller, a pair of rail members, one on each of said sides, at the forward ends of the channels, each rail member having a rear upper surface portion generally flush with the lower flange of the respective channel and a forward upper surface portion which progresses upwardly in forward direction from said rear upper surface portion to a peak, each peak being spaced from the forward end of the upper flange of the respective channel, each of the rollers of the carrier being of a diameter less than the distance between the peak and the forward end of the upper flange at that side, a latch for the carrier in one of the sides of the cabinet above the rail member at that side, means mounting the latch for pivotal movement between a latching position for preventing withdrawal of the carrier and an unlatching position permitting withdrawal of the carrier, said latch when in latching position acting in conjunction with the forward edge of the upper flange at said one side to confine a roller on the carrier at that side against upward movement away from the rear upper surface portion of the respective rail member, and said latch when in unlatching position permitting a roller on the carrier at that side to roll upwardly and forwardly over the peak of its corresponding rail member.

2. In a cabinet as set forth in claim 1, said latch having a first edge portion engageable with the peak of its corresponding rail member, thereby determining the latching position of the latch, a second edge portion extending upwardly from said first edge portion with the shortest distance from said second edge portion to the forward end of the upper flange on that side being less than the diameter of a roller on the carrier at that side, and a third edge portion inclined up and away from its first edge portion when the latch is in its latching position, said third edge portion of the latch being spaced from its corresponding peak a distance greater than the diameter of said roller when the latch is in the unlatching position to permit said roller to roll upwardly and forwardly over said peak.

3. In a cabinet as set forth in claim 2, a stop on said one side of the cabinet engageable by the latch as said latch pivots up away from its latching position to determine its unlatching position.

* * * * *